United States Patent [19]

Murray

[11] 4,276,931

[45] Jul. 7, 1981

[54] JUNK BASKET

[75] Inventor: William K. Murray, Bossier Parish, La.

[73] Assignee: Tri-State Oil Tool Industries, Inc., Bossier City, La.

[21] Appl. No.: 88,188

[22] Filed: Oct. 25, 1979

[51] Int. Cl.[3] ..... E21B 3/08

[52] U.S. Cl. ..... 166/99; 166/169; 166/319

[58] Field of Search ..... 166/99, 107, 162, 169, 166/319, 320, 325; 175/308, 311; 294/86.1, 86.11

[56] References Cited

U.S. PATENT DOCUMENTS

| | | | |
|---|---|---|---|
| 2,663,370 | 12/1953 | Donnell et al. | 166/99 |
| 3,023,810 | 3/1962 | Anderson | 166/99 |
| 3,120,872 | 2/1964 | Anderson | 166/99 |
| 3,283,823 | 11/1966 | Warrington | 166/182 |
| 3,365,007 | 1/1968 | Skipper | 175/61 |
| 3,382,925 | 5/1968 | Jennings | 166/99 |
| 4,124,245 | 11/1978 | Kuenzel | 166/99 |

*Primary Examiner*—Stephen J. Novosad
*Attorney, Agent, or Firm*—Vinson & Elkins

[57] ABSTRACT

A junk basket having a housing with cutting means on the lower end thereof and junk retaining means supported within the housing, a valve assembly mounted within the housing above the junk retaining means and including a tubular valve housing valve means for controlling flow through the valve housing, pressure responsive operating means for actuating the valve means whereby the valve means is moved between open and closed positions responsive to the stopping and starting of the flow of drilling fluids through the housing, means providing circulating of fluid through the valve housing and the basket housing when the valve means is closed, cam means for supporting the valve means in open position in one position of the cam means and releasing support from the valve means to allow it to close in a second position and stepping means for actuating the cam means between its first and second positions responsive to the starting and stopping of flow of drilling fluid through the housing.

5 Claims, 9 Drawing Figures

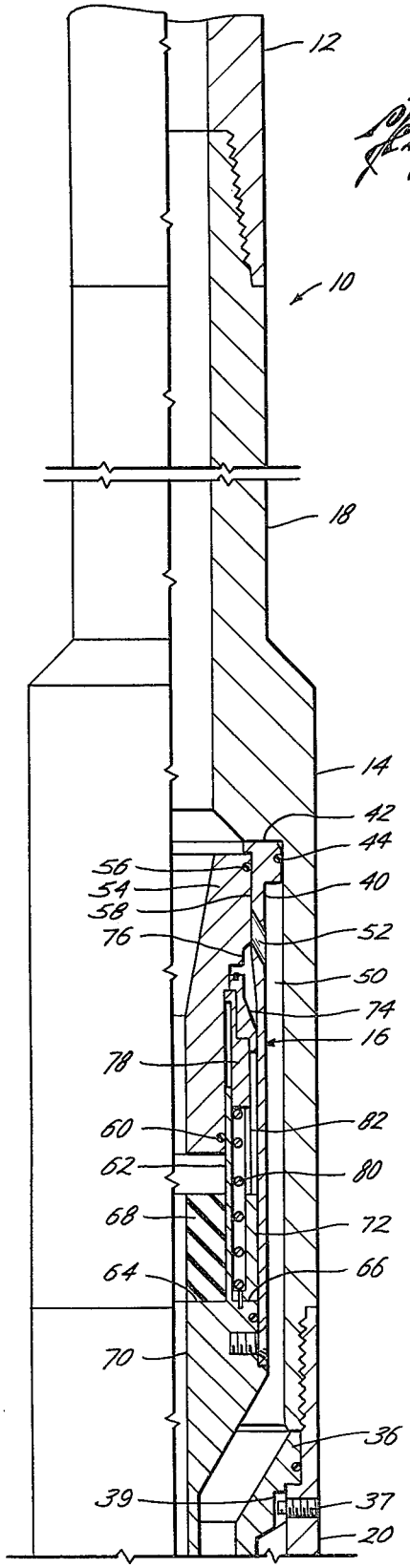
Fig. 1A
Fig. 1B
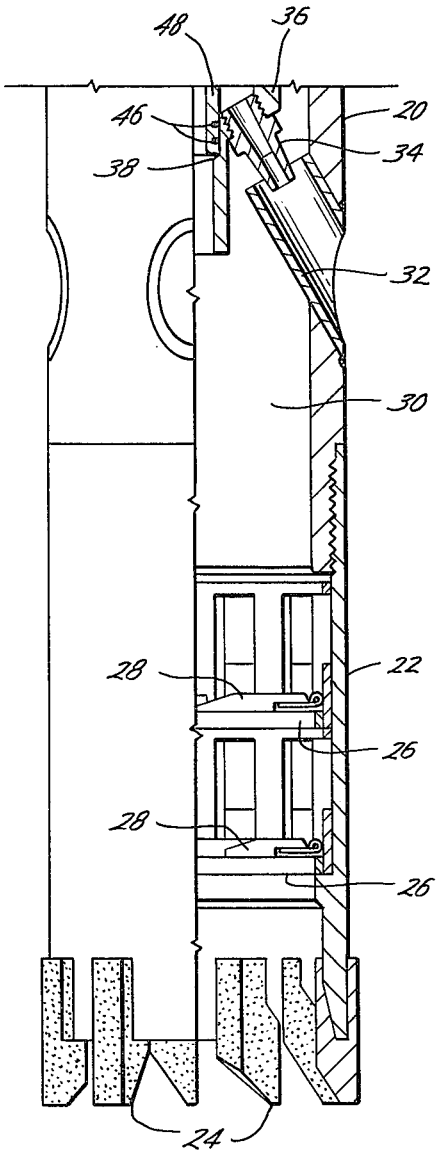

JUNK BASKET

BACKGROUND

Junk baskets have long been used in drilling wells for retrieval of junk or debris which is in the bottom of a well bore. Such junk baskets have included cutting means such as a mill of tungsten carbide inserts on the lower end of the housing and a catcher positioned above the cutting means and having means, such as pivoted fingers, which can extend into the bore to support the debris within the housing. Some prior tools have included means, such as jets, to create an upward flow through the cutting means and into the catcher chamber. These jets are activated by dropping a ball to close flow through the central bore and direct it through the jets.

The Donnell et al U.S. Pat. No. 2,663,370 discloses a junk basket with a valve controlling flow either through the bore of the device (valve open at low flow rates) or through side jets (valve closed responsive to high flow rates).

The Skipper U.S. Pat. No. 3,365,007 discloses a drilling tool in which the flow of fluid through ports in the drill bit is controlled by a piston responsive to fluid pressure.

The Warrington U.S. Pat. No. 3,283,823 discloses a well tool having a resilient ring valve member which is compressed to close the tool bore responsive to downward movement of a tubular member.

The Murray U.S. Pat. No. 3,074,486 discloses a frangible disc directing flow through side ports until it is ruptured by pressure to allow flow through the central bore.

The Kuenzel U.S. Pat. No. 4,124,245 discloses a well fishing tool with retractable and extendable gripping elements and a stop assembly with a cam which is responsive to longitudinal movement and selectively aligns or offsets the stop surfaces to prevent or allow movement of the gripping elements.

SUMMARY

The present invention relates to an improved junk basket and valve assembly therefor. The improved junk basket of the present invention has a tubular housing with cutting means on the lower end, a catcher within the housing above the cutting means, jets for educting fluids from the chamber above the catcher and a valve assembly above the chamber. The valve assembly controls flow either through the housing bore or through the jets and is responsive to changes in fluid pressure which may be created by stopping and starting the fluid circulating pump.

An object of the present invention is to provide an improved junk basket having alternate jet circulation which may be controlled from the surface without dropping a ball through the string.

Another object is to provide an improved junk basket with a valve which is controlled by starting and stopping the circulation pump.

A further object is to provide an improved junk basket with alternate jet circulation which is controlled by a valve assembly which is opened and closed by manipulation of the pressure of the circulating fluid.

Still another object is to provide an improved junk basket with a valve assembly to control alternate jet circulation which valve may be changed from open to close and from close to open as often and as many times as may be desired without having to pull the string.

BRIEF DESCRIPTION OF THE DRAWINGS

These and other objects and advantages are hereinafter set forth and explained with reference to the drawings wherein:

FIGS. 1A and 1B are elevation views of the junk basket with the right hand portion shown in section and 1B being the lower extension of 1A;

FIG. 4 illustrates the position of the apparatus with the pressure on the parts in the stop or support position and the valve open. FIG. 5 illustrates the position of the apparatus with the pressure off and the parts moved toward the non-stop position. FIG. 6 illustrates the apparatus after the pressure is again on and the parts are starting the completion of their movement toward non-stop position. FIG. 7 illustrates the apparatus as the parts complete their rotation to the non-stop position. FIG. 8 illustrates the apparatus with the pressure on and the valve closed.

DESCRIPTION OF THE PREFERRED EMBODIMENTS

Figure 3:
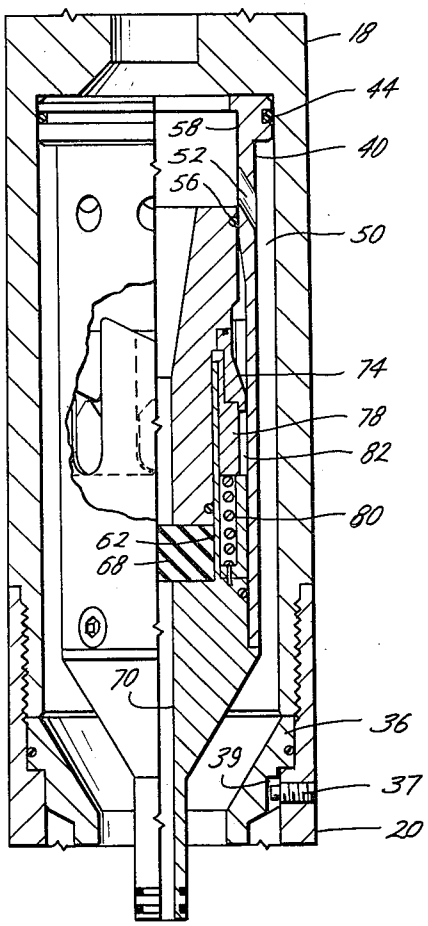
FIG. 3 is a view similar to FIG. 2 but showing the valve assembly closed position.
Figure 2:
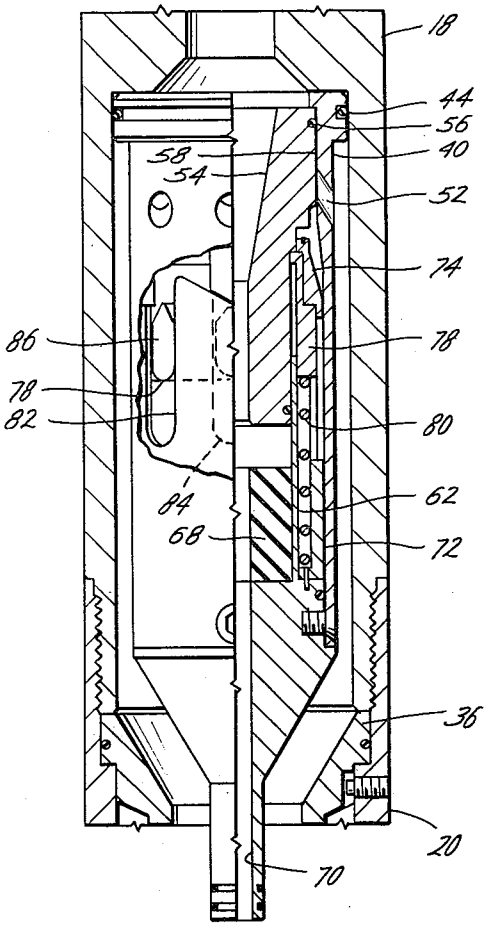
FIG. 2 is a quarter sectional view of the improved valve assembly in open position.

The improved junk basket 10 of the present invention is shown in FIG. 1 connected to a string 12 and having tubular housing 14 with valve assembly 16 secured within housing 14 as shown. Tubular housing 14 includes top sub 18, nozzle housing 20 and basket head 22. Cutting means such as hard metal inserts or milling teeth 24 are provided on the lower end of basket head 22. Catchers 26 having pivoted fingers 28 are included within basket head 22 above the cutting means.

To establish reverse circulation upwardly through catchers 26, chamber 30 which is above catchers 26 is in communication with the inner end of nozzles 32 which extend from a position within chamber 30 to the exterior of nozzle housing 20. Jets 34 are positioned to direct fluid flow when valve assembly 16 is closed through nozzles 32 to create a reduced pressure in chamber 30 whereby junk is drawn into chamber 30 where it can be retained by catchers 26. Jets 34 are supported on jet housing 36 which extends inwardly from nozzle housing 20 and has internal seat 38. Alignment pin 37 which is threaded through housing 20 engages within slot 39 in jet housing 36 to orient jets 34 within their respective nozzles 32.

Valve assembly 16 includes valve housing 40 which is positioned between downwardly facing shoulder 42 on the interior of top sub 18 and internal seat 38. Seal ring 44 provides a seal between the upper exterior of valve housing 40 and the interior of top sub 18. Seal rings 46 provide a seal between the internal surface 48 of jet housing 36 and the lower exterior of valve housing 40. The exterior of valve housing 40 below seal 44 is spaced inward from the interior of tubular housing 14 to form annular passage 50 in communication with jets 34. Port 52 extends through valve housing 40 to provide circulation of fluids to passage 50 when port 52 is not closed by piston 54.

Piston 54 is slidably mounted within valve housing 40 when seal 56 against inner surface 58 and seal 60 against the interior of upwardly extending tubular rim 62. The lower portion of valve housing 40 includes upwardly facing shoulder 64 inside rim 62 and upwardly facing shoulder 66 outside rim 62. Flexible annular valve ring 68 is positioned on shoulder 64 and is moved to close flow through bore 70 in the lower end of valve housing 40 by being compressed inwardly to the position shown in FIG. 3 by compression between the lower end of piston 54 and shoulder 64.

A stop means is provided to support piston 54 in its open position even when substantial pressures are developed on piston 54 as a result of the flow of fluid therethrough. Such stop means includes lower stop ring 72 positioned on shoulder 66, upper stop ring 74 which engages shoulder 76 on piston 54, camming ring 78 and spring 80 which urges camming ring 78 upwardly. As best seen in FIGS. 4 through 8, lower stop ring 72 includes a plurality of equally spaced slots 82 with groove 84 positioned mid-way between each pair of slots 82. Camming ring 78 is positioned within ring 72 and has its projections 86 positioned in slots 82 and grooves 84. Spring 80 urges ring 78 upwardly. Upper ring 74 includes a plurality of depending fingers 88 being the same in number as the number of slots 82 in ring 72. The upper portion of ring 72 between slots 82 is tapered downwardly and to the right at 90 when viewed externally to the right hand side of groove 84, then is stepped upwardly forming shoulder 92 and then tapered downwardly to the right at 94 into slot 82. The upper ends of projections 86 taper upwardly to a point as shown. The lower ends of fingers 88 are tapered downwardly to the right at 96 as shown to mate with the tapers on the upper surfaces of ring 72.

Figures 4, 5, 6, 7, 8:
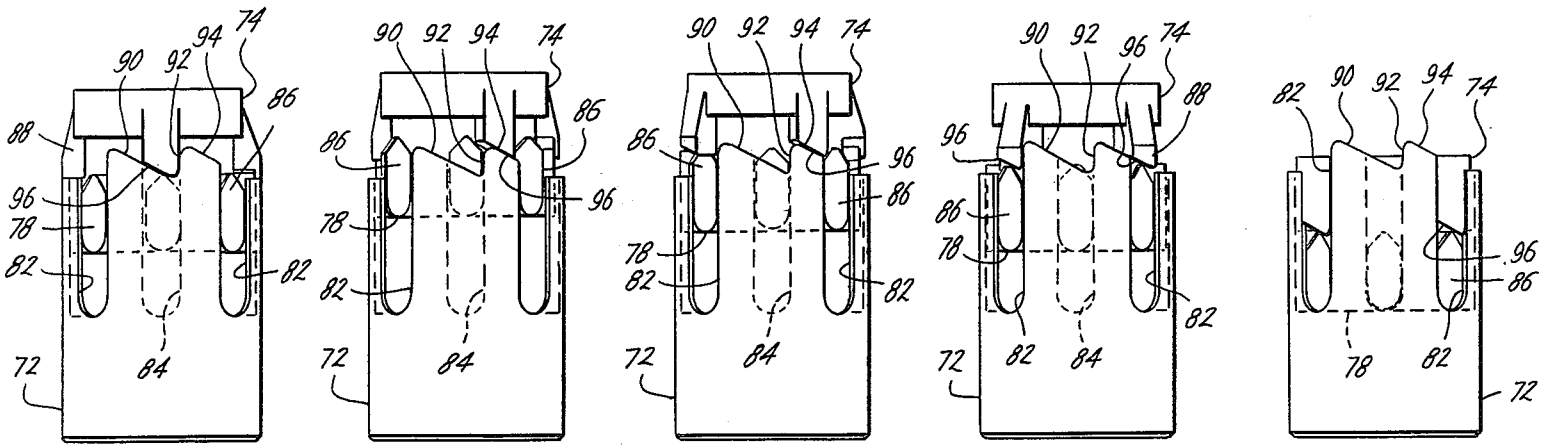
FIGS. 4 through 8 are views of the cam stop and stepping apparatus.

The operation of the stop means in supporting piston 54 in its open position and releasing such support to allow piston 54 to move to its closed position is best explained with reference to FIGS. 4 through 8. In FIG. 4, piston 54 is supported since fingers 88 reset on the tapered upper surface 90 of ring 72 and against the side of step shoulder 92. In this position, valve assembly 16 is open, piston 54 is under pressure, and circulation is directed to bore 70 and the interior of basket head 22 for normal milling of junk by the milling teeth 74.

When it is desired that valve assembly 16 be closed, the pump is stopped. As shown in FIG. 5, spring 80 moves camming ring 78 upward sufficiently so that the points on the upper ends of projections 86 raise upper stop ring 74 above shoulder 92 and cams ring 74 to the right so that fingers 88 rest on tapered surface 94. After a short interval with pump off it is again started and pressure is delivered to valve assembly 16. This pressure is exerted on piston 54 to force it downward. The initial movement is shown in FIG. 6 wherein ring 74 is moving downward and being rotated to the right by engagement on tapered surface 94. This movement continues until fingers 58 enter slots 82 as shown in FIG. 7, and then both ring 74 and camming ring 78 are moved downward to the position shown in FIG. 8. In this position, piston 54 has engaged and compressed valve ring 68 to the closed position shown in FIG. 3. Also, the downward movement of piston 54 uncovers port 52. With port 52 open and valve ring 68 closed circulation is through port 52, annular passage 50 and jets 34 into nozzles 32 to educt fluids from chamber 30 out through nozzles 32. This circulation causes junk to rise in chamber 30 where it is caught by fingers 28 and baskets 26. With chamber 30 substantially full, the pump can be shut off and spring 80 forces piston 54 upward to close port 52 and open valve ring 68. This allows junk basket 10 to be pulled from the well bore, and fluids in string 12 to drain through valve ring 68. The release of pressure on piston 54 allows spring 80 to force camming ring 78 upward causing ring 74 to be rotated to position fingers 88 on the upper portion of surface 90 so that when pressure is again applied to piston 54 ring 74 is moved to the piston supporting or open position shown in FIG. 4.

What is claimed is:

1. A junk basket comprising a housing having central bore extending therethrough, cutting means on the lower end of said housing, junk retaining means supported within said housing central bore, a valve assembly mounted within the bore of said housing above said junk retaining means, said valve assembly including a tubular valve housing positioned in said housing bore, valve means for controlling flow through said valve housing, pressure responsive operating means with support means for actuating said valve means whereby said valve means is moved responsive to the stopping and starting of the flow of drilling fluid through said housing between supported open position and unsupported position allowing closing, and means providing circulation of fluid through said valve housing and said basket housing when said valve means is closed.

2. A junk basket comprising a housing having central bore extending therethrough, cutting means on the lower end of said housing, junk retaining means supported within said housing central bore, a valve assembly mounted within the bore of said housing above said junk retaining means, said valve assembly including a tubular valve housing positioned in said housing bore, valve means for controlling flow through said valve housing, pressure responsive operating means for actuating said valve means whereby said valve means is moved between open and closed positions responsive to the stopping and starting of the flow of drilling fluid through said housing, means providing circulation of fluid through said valve housing and said basket housing when said valve means is closed, a pressure responsive member slidable within said valve housing and engaging said valve means to open and close said valve means, stop means within said housing supporting said pressure responsive member against movement in one position and allowing said pressure responsive member to more closing said valve means in the other position, and stepping means coacting with said stop means to move said stop means between positions responsive to stopping and starting of the flow of drilling fluid through said housing.

3. A junk basket according to claim 2 wherein said pressure responsive member is a piston closing said circulation providing means when said valve means is open.

4. A junk basket according to claim 2 wherein said stop means include a pair of coacting cam rings, and said stepping means includes a stepping ring biased to engage one of said cam rings to cause it to rotate responsive to start and stopping flow of fluid flow through the housing.

5. A junk basket comprising a main tubular housing having a central bore, cutting means on the lower end of said housing, junk retaining means supported in said housing central bore above said cutting means, at least one nozzle communicating through said tubular housing from a chamber above said junk retaining means, a valve assembly including a valve housing secured within said tubular housing and having a central bore, the upper exterior of said valve housing being in sealing engagement with the interior of said main housing, the remaining exterior of said valve housing being spaced from the interior of said main housing, a jet housing secured to the interior of said main housing and the lower end of said valve housing, a jet extending through said jet housing into the inner end of said nozzle, an annular resilient valve ring supported on an upwardly facing shoulder on the interior of said valve housing, a port through said valve housing near its upper end, an annular piston slidable within said valve housing, downward movement of said piston compressing said annular valve ring against said shoulder to close flow through the central bore of said valve housing, an upper cam ring engaging a downwardly facing shoulder on said piston, a lower cam ring engaging said shoulder on said valve housing, said cam rings having coacting surfaces whereby in a first position said cam rings support said piston and prevent its downward movement responsive to pressure and in a second position interdigitate to allow said piston to move to close said valve ring, and a stepping ring coacting with said cam rings and biased upwardly, said stepping ring moving over said cam rings between said positions responsive to reduction of pressure of drilling fluid through said valve assembly, movement of said piston to closed position uncovering said part in said valve housing to establish flow through said jet and said nozzle whereby junk is circulated into said chamber.

* * * * *